US006293122B1

(12) United States Patent
Chang

(10) Patent No.: US 6,293,122 B1
(45) Date of Patent: Sep. 25, 2001

(54) REFRIGERATOR

(75) Inventor: Heon Jae Chang, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/450,000

(22) Filed: Nov. 26, 1999

(30) Foreign Application Priority Data

Nov. 28, 1998 (KR) ..... 98-51557

(51) Int. Cl.[7] ..... F25D 17/04
(52) U.S. Cl. ..... 62/408; 62/414
(58) Field of Search ..... 62/413, 414, 426, 62/408

(56) References Cited

U.S. PATENT DOCUMENTS 2,708,349 * 5/1955 Kuhn ..... 62/414
5,911,750 * 6/1999 Mandel et al. ..... 62/407
5,979,174 * 11/1999 Kim et al. ..... 62/413

* cited by examiner

*Primary Examiner*—William Doerrler
*Assistant Examiner*—Mohammad M Ali
(74) *Attorney, Agent, or Firm*—Fleshner & Kim, LLP

(57) ABSTRACT

Refrigerator, in which a circulation path of cold air in the refrigerator is simplified for increasing an effective space of the refrigerator and improving refrigerator efficiency, including cold air supplying means in front of a heat exchange chamber for supplying cold air heat exchanged in the heat exchange chamber to a refrigerating chamber and a freezing chamber, a discharge guide in rear of a barrier in communication with the cold air supplying means, for guiding the cold air from the cold air supplying means to the refrigerating chamber, and cold air feed back means in rear of the barrier and the rear wall of the refrigerator for guiding the cold air circulated through the refrigerating chamber to the heat exchange chamber.

15 Claims, 7 Drawing Sheets

REFRIGERATOR

BACKGROUND OF THE INVENTION

1. Field of the Invention

The present invention relates to a refrigerator, and more particularly, to a refrigerator, in which a circulation path of cold air in the refrigerator is simplified for increasing an effective space of the refrigerator and improving refrigerator efficiency.

2. Background of the Related Art

A related art refrigerator will be explained with reference to FIG. 1. The related art refrigerator is provided with a freezing chamber 2, a refrigerating chamber 4, which are separated by a barrier 5, and a heat exchange chamber 6 in rear of the refrigerating chamber 2. In detail, there are an evaporator 7 and fan 8 in the heat exchange chamber 6. There is a shroud for guiding flow of cold air in front of the fan 8, and there is a grill pan 12 having a cold air discharge opening 12*a* for the freezing chamber in front of the shroud 11. And, there is a refrigerating chamber duct 4*a* in rear of the refrigerating chamber 4, and there are freezing chamber feed back duct 5*a* and a feed back duct 5*b* in the barrier 5 for feeding the cold air circulated through the freezing chamber and the refrigerating chamber respectively back to the heat exchange chamber 6.

Circulation paths of the cold air will be explained with reference to FIG. 1. The cold air heat exchanged in the heat exchange chamber 6 has one portion supplied to the freezing chamber 2 and the other potion supplied to the refrigerating chamber 4. In detail, the cold air is supplied to the freezing chamber 2 through an opening 11*a* in the shroud 11 and openings 12*a* in the grill pan 12 as well as to the refrigerating chamber duct 4*a* connected to a space between the shroud 11 and the grill pan 12. The cold air supplied to the freezing chamber 2 and the refrigerating chamber 4 has heat exchanged with stored food as the cold air circulates through insides of the freezing chamber and the refrigerating chamber. The cold air circulated through the freezing chamber 2 and the refrigerating chamber 4 is fed back to the heat exchange chamber 6 through the freezing chamber feed back duct 5*a* and the feed back duct 5*b,* respectively.

In the meantime, as shown in FIG. 2, there is an insulating layer 1 formed in a rear wall, i.e., between an outer case 1*a* and inner cases 2*a* and 4*a,* of the refrigerator by foaming and stuffing with polyurethane which has an excellent insulating property. However, there is an insulating layer in the barrier 5 of styrofoam formed to a required shape and inserted therein such that the freezing chamber feed back duct 5*a* and the feed back duct 5*b.* In detail, a styrofoam insulating member 5*c* formed in a required shape is inserted in the barrier 5 in advance, and gaps between a rear end of the insulating memeber 5*c* and the inner cases 2*a,* and 4*a* are selected with a tape 5*a.* Then, foam is stuffed in a space between the outer case 1*a* and the inner cases 2*a* and 4*a* of the refrigerator, to form an insulating layer 1. The rear end of the styrofoam insulating member 5*c* is sealed for preventing infiltration of the foam liquid into the barrier 5. Styrofoam, which cost higher than polyurethane, is stuffed in the barrier 5 instead of polyurethane for preventing deformation of the feed back duct by a foaming pressure of polyurethane.

However, the related art refrigerator structure has the following problems.

First, the use of styrofoam in the barrier as an insulating member in the related art causes many problems. The poorer insulating property of the styrofoam than polyurethane requires to provide a thicker styrofoam for obtaining a desired insulating performance, which in turn reduces effective spaces of the freezing chamber and the refrigerating chamber. The requirement to seal the end portion of the styrofoam insulating member for stuffing a space between the inner cases and the outer case of the refrigerator with foam when the styrofoam insulating member is used causes an increased process steps required in preliminary assembly line, that drops a productivity. Besides, the styrofoam is expensive, and we should refrain from using the styrofoam in view of environment conservation.

Second, the related art cold air circulating paths have the following disadvantages; the cold air circulated through the freezing chamber and the refrigerating chamber respectively is guided to a front surface of the evaporator 7 before being fed back to the heat exchange chamber, which results in concentrated contact of the cold air at the front surface of the evaporator, that leads to a poor heat exchange efficiency. And, the complicated path of the cold air to the refrigerating chamber with the shroud and the grill pan and bends results in a high flow path resistance, which impedes a smooth supply of the cold air to the refrigerating chamber, with a poor refrigerator efficiency.

SUMMARY OF THE INVENTION

Accordingly, the present invention is directed to a refrigerator that substantially obviates one or more of the problems due to limitations and disadvantages of the related art.

An object of the present invention is to provide a refrigerator which can maximize an effective space for storage of food.

Another object of the present invention is to provide a refrigerator in which a cold air circulating path is optimized for increasing a heat exchange efficiency.

Other object of the present invention is to provide a refrigerator in which an assembly process is simplified for improving a productivity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the refrigerator includes cold air supplying means in front of a heat exchange chamber for supplying cold air heat exchanged in the heat exchange chamber to a refrigerating chamber and a freezing chamber, a discharge guide in rear of a barrier in communication with the cold air supplying means, for guiding the cold air from the cold air supplying means to the refrigerating chamber, and cold air feed back means in rear of the barrier and the rear wall of the refrigerator for guiding the cold air circulated through the refrigerating chamber to the heat exchange chamber.

The cold air supplying means includes a cold air flow passage having at least one cold air discharge opening for permitting the cold air discharged from the heat exchange chamber to flow to the freezing chamber, and, preferably, further includes a cold air feed back opening for feeding the cold air circulated through the freezing chamber back to a front surface of the heat exchange chamber.

The discharge guide includes a cold air discharge passage in communication with the cold air passage in the cold air supply means, and a defrosted water drain passage in communication with the heat exchange chamber.

The cold air feed back means is fitted under the barrier and includes a feed back duct assembly having a feed back duct for flowing the cold air circulated through the refrigerating chamber, and a feed back guide having an inlet side in communication with an outlet side of the feed back duct assembly, and an outlet side in communication with rear of the heat exchange chamber.

The barrier is stuffed with polyurethane, to form an insulating layer.

Thus, the reduction of a barrier thickness permits to maximize effective spaces of the refrigerator, and the optimized circulating flow paths improves a heat exchange efficiency.

And, the simplified assembly process can improve a productivity.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
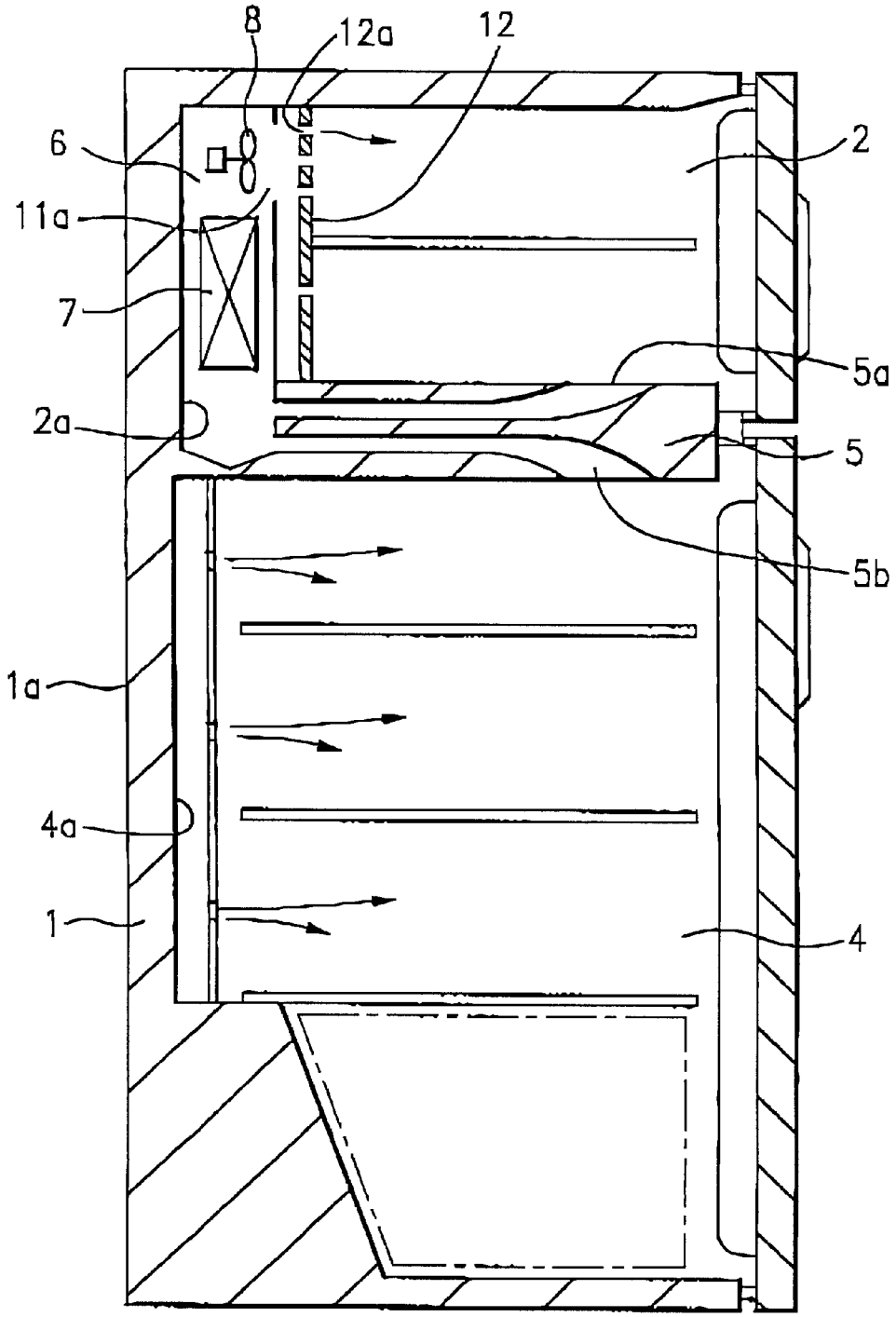
FIG. 1 Related Art
FIG. 1 illustrates a section showing a related art refrigerator.
Figure 2:
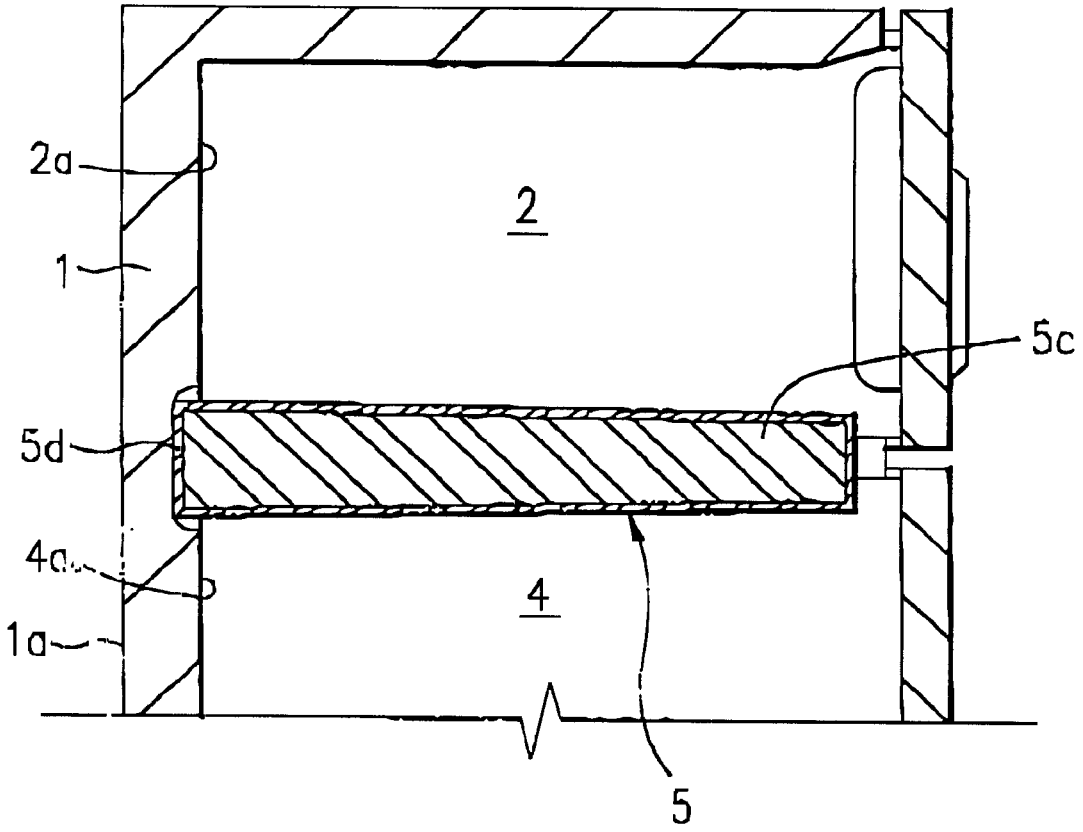
FIG. 2 Related Art
FIG. 2 illustrates a partial section showing a barrier in the related art refrigerator.
Figure 3:
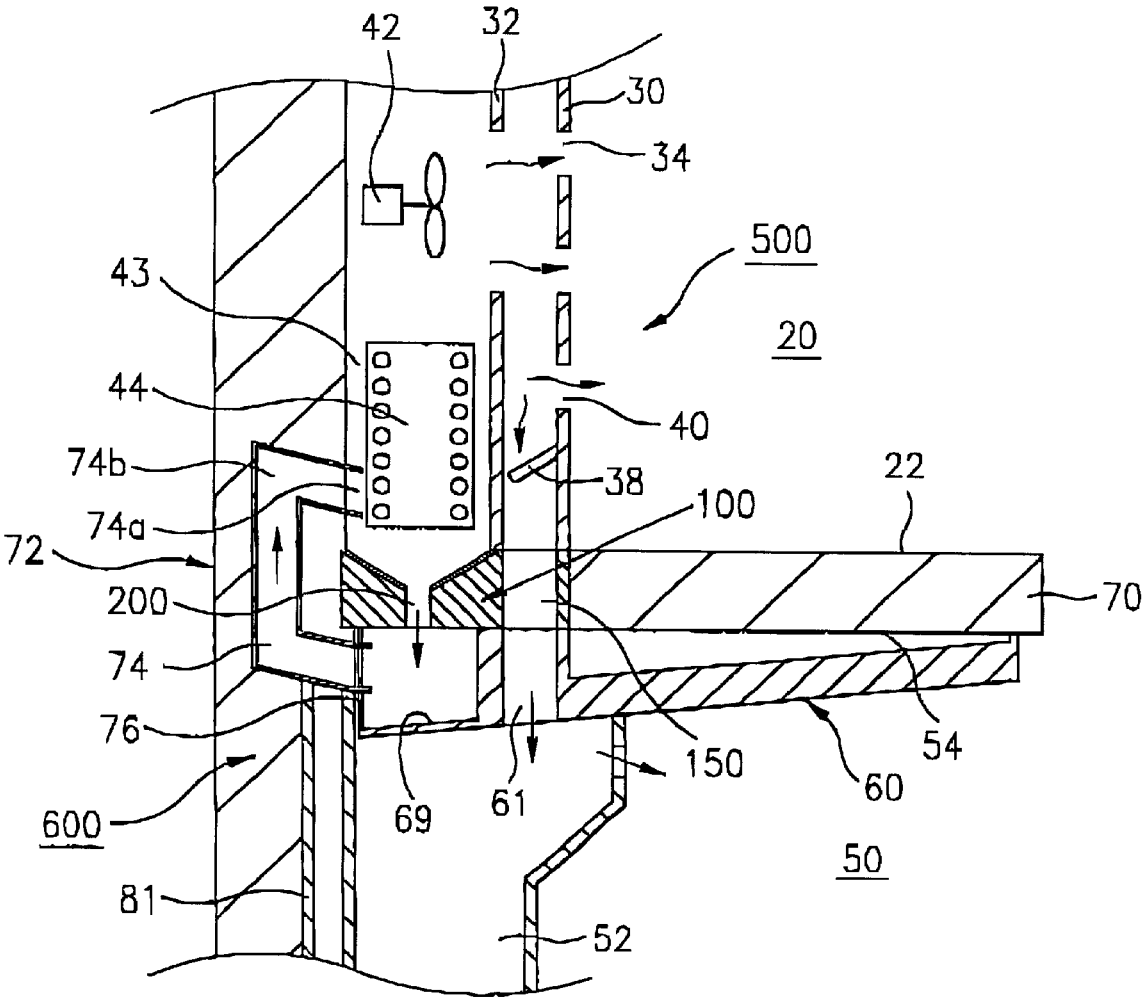
FIG. 3 illustrates a section across line I—I in FIG. 6, showing a refrigerator in accordance with a preferred embodiment of the present invention.
Figure 6:
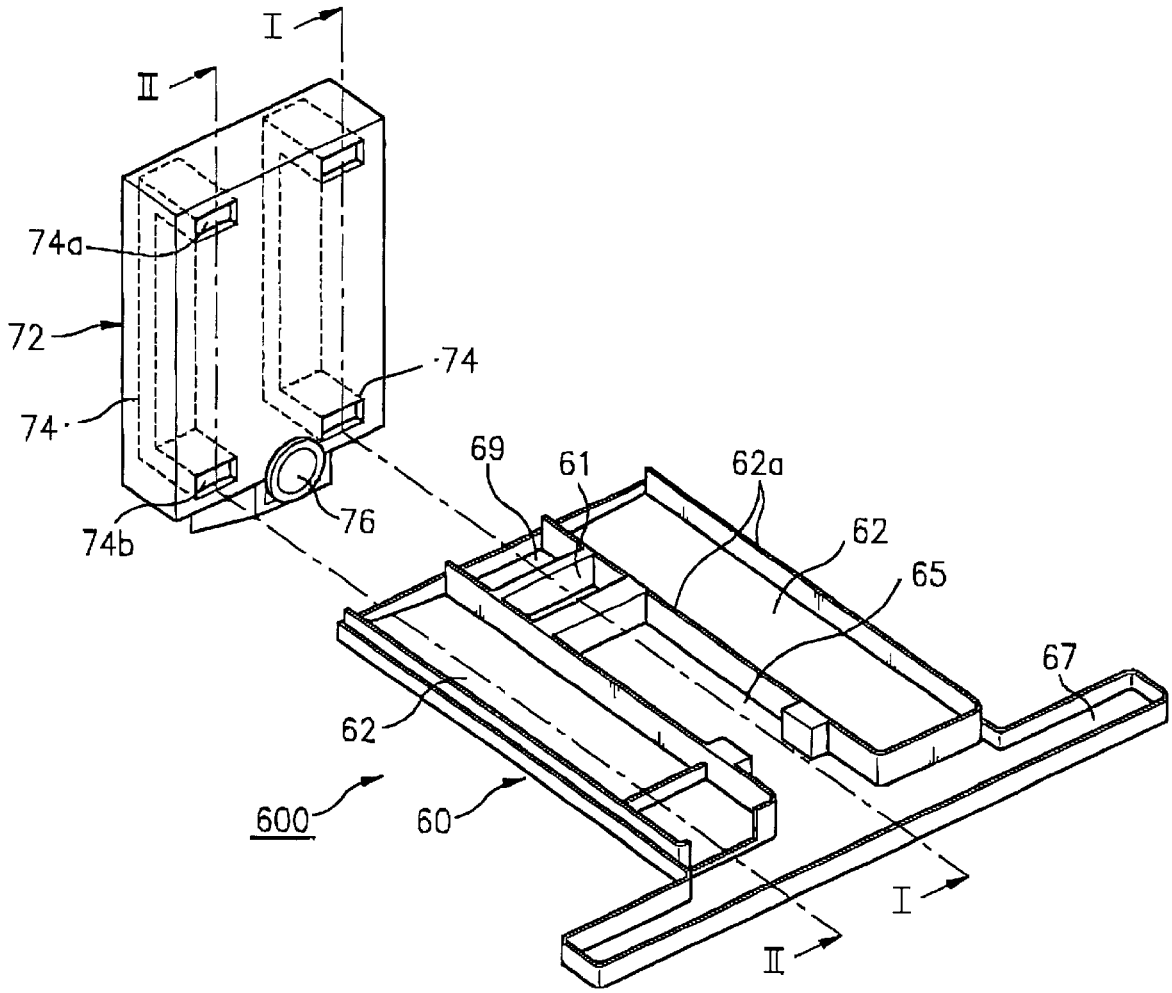
FIG. 6 illustrates a perspective disassembled enlarged view of a cold air feed back means in FIG. 3.

Reference will now be made in detail to the preferred embodiments of the present invention, examples of which are illustrated in the accompanying drawings. FIG. 3 illustrates a section across line I—I in FIG. 6, showing a refrigerator in accordance with a preferred embodiment of the present invention, referring to which an overall structure of the refrigerator of the present invention will be explained.

There is cold air supply means 500 in front of an evaporator 44 for supplying the cold air heat exchanged in the evaporator 44 to a refrigerating chamber and a freezing chamber. And, there is a discharge guide 100 in rear of a barrier 70 for guiding the cold air from the cold air supply means 500 to the refrigerating chamber. There is cold air feed back means 600 in a bottom of the barrier 70 and in a rear wall of the refrigerator for feeding the cold air circulated through the refrigerating chamber. The cold air feed back means 600 includes a feed back duct assembly under the barrier 70, which has an upper surface 22 and a lower surface 54, and a feed back guide 72 having one side in communication with the feed back duct assembly 60 and the other side in communication with a heat exchange chamber 43 for feeding the cold air in the refrigerating chamber to the heat exchange chamber 43.

Respective elements will be explained.

Figure 4:
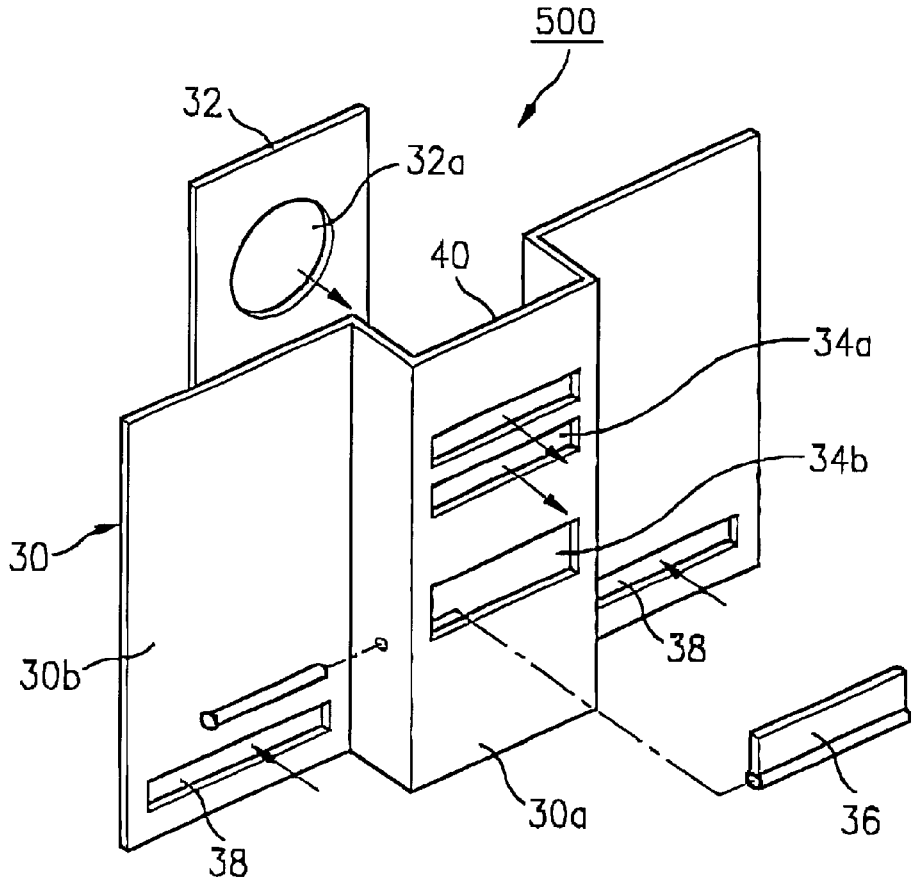
FIG. 4 illustrates a perspective disassembled enlarged view of a cold air supply means in FIG. 3.

First, referring to FIGS. 3 and 4, the cold air supply means 500 will be explained. The cold air supply means 500 includes a grill pan 30 and a cover 32 fitted to a back surface of the grill pan 30 for supplying the cold air heat exchanged in the heat exchange chamber 43 to the freezing chamber and the refrigerating chamber, and feeding the cold air circulated through the freezing chamber back to the heat exchange chamber 43. A portion of a center portion of the grill pan 30 is projected forward (to the freezing chamber side) to form a projected portion 30*a*, in rear of which a cover 32 is provided so that a space 40 between the projected portion 30*a* and the cover 32 serves as a cold air passage for the cold air heat exchanged in the evaporator 44. There is an opening 32*a* in an upper portion of the cover 32 for supplying the cold air heat exchanged in the heat exchange chamber by means of a fan 42. There are cold air discharge openings 34 for the freezing chamber, i.e., an upper discharge opening 34*a* and a middle discharge opening 34*b* in an upper portion of the projected portion 30*a* in the grill pan 30, for discharging the cold air to the freezing chamber 20. And, there is a freezing chamber feed back opening 38 in a lower portion of a portion 30*b* which is not projected for feeding the cold air circulated through the refrigerating chamber 20 back to a front surface of the evaporator. There is a regulating plate 36 rotatably fitted in a lower portion of the cold air passage 40 for regulating supply of the cold air to the refrigerating chamber. If the regulating plate 36 closes the cold air passage 40, cold air supply to the refrigerating chamber 50 is cut off, to supply the cold air only to the freezing chamber 20. The regulating plate 36 may be in different forms, such as a baffle of a damper.

Figure 5:
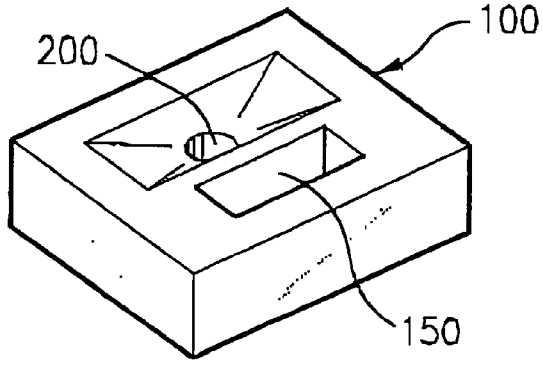
FIG. 5 illustrates a perspective enlarged view of a cold air discharge guide in FIG. 3.

The discharge guide 100 will be explained with reference to FIGS. 3 and 5.

The discharge guide 100 is fitted in rear of the barrier 70. The discharge guide 100 has a refrigerating discharge passage 150 in communication with the cold air passage 40 in the cold air supply means 500. The cold air discharge guide 100 preferably has a defrosted water drain passage 20 for draining defrosted water from frost on the evaporator 44. Accordingly, a portion of cold air heat exchanged in the heat exchange chamber 43 is discharged to the freezing chamber through the cold air discharge opening 34 in the cold air supply means 500, and the cold air guided to downward is supplied to the refrigerating chamber duct 52 through the refrigerating discharge passage 150 and a refrigerating chamber supply opening 61 in the feed back duct assembly 60, which will be explained later.

Cold air feed back means 600 will be explained with reference to FIGS. 3 and 6.

The cold air feed back means 600 includes a feed back duct assembly 60 fitted under the barrier 70, and a feed back guide 72 substantially vertically fitted to one end of the feed back duct assembly 60 and buried in the rear wall of the refrigerator. There is a feed back duct 62 on each side of the feed back duct assembly 60 for guiding the cold air circulated through the refrigerating chamber 50 toward the evaporator 44, and there are a refrigerating chamber supply opening 61 and a defrosted water collector 69 are formed at an approx. center in a rear portion of the feed back duct assembly 60 in communication with the refrigerating discharge passage 150 in the discharge guide 100 and the defrosted water passage 200, respectively. The feed back duct 62 is one pair of projections 62*a* closely fitted to an under side of the barrier 70, to form cold air feed back passages. And, there is a cold air opening 62*a* in a front portion (in a direction of the door) of the feed back duct 62 for receiving the cold air from the refrigerating chamber. It is preferable that a bottom surface of an end portion (a portion adjacent to the feed back guide) of the feed back duct 62 faces the defrosted water collector 69 with a downward slope for easy collection of water drops formed in the feed back passage 74 in the feed back guide connected to the feed back duct 62. The feed back guide 72 in rear of the feed back duct assembly 62 guides the cold air flowed to the feed back duct assembly toward the evaporator 44. There are one pair of feed back passages 74 on opposite sides of the feed back guide 72, with a lower end connected to one end of the feed back duct 62 and an upper end in communication with a rear of the heat exchanger chamber 43. Therefore, the air circulated through the refrigerating chamber 50 is fed back to a rear surface of the evaporator 44 through the feed back duct 62 and the feed back passage 74, such that the air is mostly brought into contact with the rear surface of the evaporator 44 for heat exchange. It is preferable that an outlet 74*a* of the feed back passage 74 is sloped downwardly for preventing reverse flow of the cold air. It is preferable that a front portion and a middle portion(between one pair of feed back ducts) of the feed back duct assembly are cut away to form cavities 65 and 67 for fitting various electric components which should be fitted inside of the refrigerator, such as refrigerating chamber lamp, door switch, timer, and etc.

The present invention facilitates formation of an insulating layer of polyurethane having excellent insulating performance and strength in the barrier 70 instead of the styrofoam in the related art, because separate cold air circulating means 600, i.e., the feed back guide, the feed back assembly and the like can be used instead of forming the various ducts in the barrier 70, which serve as passages for feeding back the cold air in the barrier 70 to the evaporator.

Cold air circulating paths in the refrigerator of the present invention will be explained with reference to FIGS. 3, 7 and 8.

Referring to FIG. 3, the cold air produced in the heat exchange chamber 43 is supplied to the cold air supply means 500 by the fan 42. A portion of the cold air supplied to the cold air supply means 500 is supplied to the freezing chamber 20 through the discharge opening 34. And, the other portion of the cold air flows downward along the cold air passage 40, and is supplied to the refrigerating chamber 50 through the refrigerating discharge passage 150, the refrigerating chamber supply opening 61, and the refrigerating chamber duct 52. The cold air supply to the refrigerating chamber 50 can be regulated by the regulating plate 36. Different from the related art, because the present invention has substantially straight cold air supply paths, a flow resistance can be minimized while cold air supply to the refrigerating chamber is made smooth.

Figure 7:
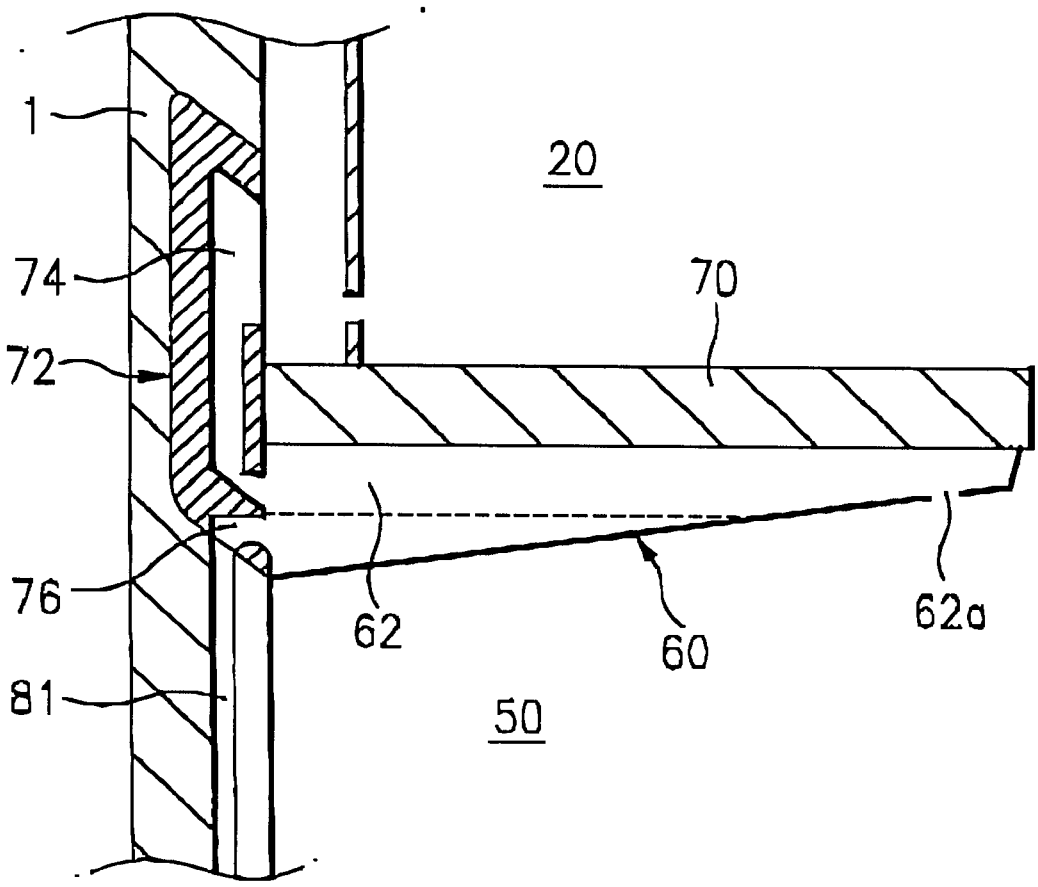
FIG. 7 illustrates a partial section across line II—II in FIG. 6, showing an assembled barrier in FIG. 3; and, FIG. 8 illustrates an overall cold air circulating paths of a refrigerator in accordance with a preferred embodiment of the present invention, schematically.
Figure 8:
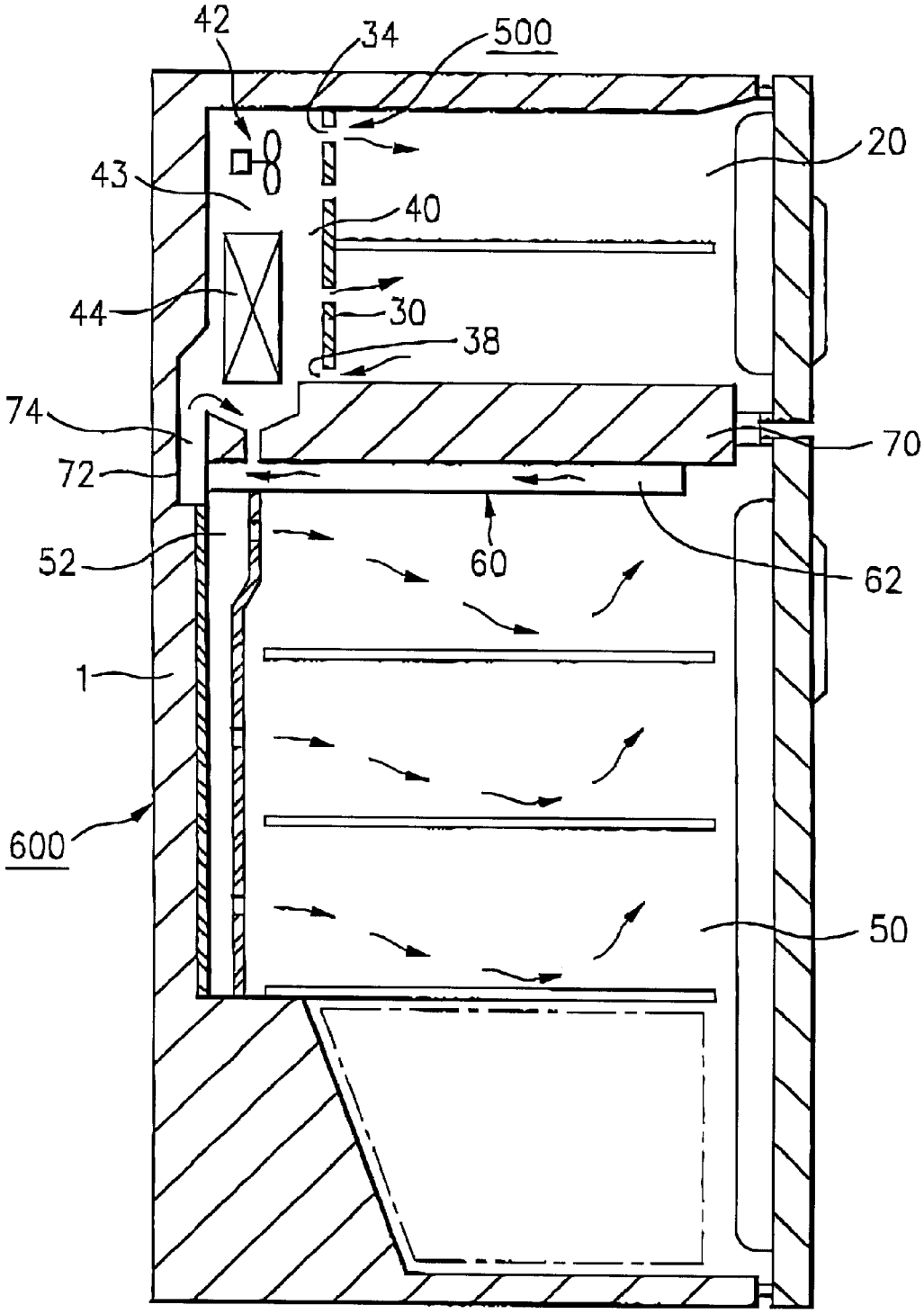

In the meantime, referring to FIGS. 7 and 8, the cold air relatively heated as being heat exchanged in the refrigerating chamber 50 flows into the feed back duct 62 through an inlet portion 62*a* of the feed back duct assembly 60. The air flowed to the feed back duct 62 is fed back to the heat exchange chamber 43 through the feed back passage 74 in the feed back guide 72. The cold air fed back to the heat exchange chamber 43 comes to contact with the rear surface of the evaporator 44. On the other hand, the cold air circulated through the freezing chamber 20 is fed back to the heat exchange chamber 43 through the freezing chamber feed back opening 38 in the grill pan 30. In this instance, the cold air fed back to the heat exchange chamber 43 comes to contact with the front surface of the evaporator 44. Thus, as the cold air circulated through the freezing chamber 20 and the refrigerating chamber 50 respectively are guided to the front surface and the rear surface of the evaporator, to heat exchange in the front and rear surfaces, a heat exchange efficiency can be improved.

A process for draining defrosted water produced in the evaporator will be explained.

A defrosting process is carried out periodically for removing frost grown on a surface of the evaporator 44 after a period of operation. The defrosting process is removal of the frost on the surface of the evaporator by putting a heater(not shown) on the evaporator into operation. The defrosted water produced in the defrosting process of the evaporator 44 is collected in the defrosted water collector 69 through the draining passage 200 in the discharge guide 100. Since the defrosted water collector 69 is formed at a rear end of the feed back duct assembly 60, with a slope, the defrosted water dropped from the feed back duct 74 in the feed back guide 72 is collected to the defrosted water collector 69, actually. The defrosted water collected thus is collected to a defrosted water container in a machinery room in a lower portion of rear of the refrigerator through the defrosted water drain opening 76 and a drain pipe 81, and vaporized therefrom.

The refrigerator of the present invention has the following advantages.

First, the stuffing inside of the barrier with an insulating layer of a material having an excellent insulating property, such as polyurethane, permits to form a thinner barrier while the barrier has an adequate insulating performance, that enlarges effective spaces of the freezing chamber and the refrigerating chamber. And, since the styrofoam can be dispensed with, cost saving and strengthening are possible. Especially, since formation of feed back passages for the freezing chamber and the refrigerating chamber in the barrier can be dispensed with, the present invention is favorable in view of strength. And, since the styrofoam can be dispensed with, which permits to omit sealing process, a refrigerator assembly process is simplified.

Second, the feed back of the air circulated through the freezing chamber to the front surface of the evaporater and the air circulated through the refrigerating chamber to the rear surface of the evaporator, permitting heat exchange on the front and rear surfaces of the evaporator, improves heat exchange efficiency. And, since such a feed back system permits formation of frost on all over the evaporator even, an air flow passing through the evaporator is uniform on the whole, which improves a heat exchange efficiency of the evaporator, and cooling performance of the refrigerator, and reduces power consumption.

Third, the almost straight cold air supply paths to the refrigerating chamber can reduce flow resistance, which further improves the refrigerating performance.

Finally, the defrosted water collector for collecting defrosted water provided in the feed back assembly in the cold air feed back means reduces a number of components and permits an assembly procedure simple.

And, the fitting of various components, such as door switches, a refrigerating chamber lamp, and etc., utilizing spaces other than the feed back ducts in the feed back assembly is favorable in view of convenience of overall inner space utilization and maintenance.

It will be apparent to those skilled in the art that various modifications and variations can be made in the refrigerator of the present invention without departing from the spirit or scope of the invention. Thus, it is intended that the present invention cover the modifications and variations of this invention provided they come within the scope of the appended claims and their equivalents.

What is claimed is:

1. A refrigerator comprising:

a cold air supplying device in front of a heat exchange chamber, wherein the cold air supplying device includes a cold air passage with a regulating plate and at least one cold air discharge opening;

a discharge guide in a rear portion of a barrier, wherein the discharge guide is in communication with the cold air supplying device; and, a cold air feed back device in the rear portion of the barrier.

2. The refrigerator as claimed in claim 1, wherein the cold air supplying device further includes a cold air feed back opening.

3. The refrigerator as claimed in claim 1, wherein the cold air flow passage is formed by projecting a grill pan forward, and fitting a cover onto a rear portion of the projection of the grill pan, and the cold air feed back opening is formed in a portion other than the projection of the grill pan.

4. The refrigerator as claimed in claim 1, wherein the discharge guide comprises:

a cold air discharge passage in communication with the cold air passage in the cold air supplying device, and a defrosted water drain passage in communication with the heat exchange chamber.

5. The refrigerator as claimed in claim 4, wherein the cold air feed back device comprises a feed back duct assembly that further includes a defrosted water collector in communication with the defrosted water draining passage in the discharge guide.

6. The refrigerator as claimed in claim 1, wherein the cold air feed back device is fitted under the barrier and comprises:

a feed back duct assembly having a feed back duct, and a feed back guide having an inlet side in communication with an outlet side of the feed back duct assembly, and an outlet side in communication with the heat exchange chamber.

7. The refrigerator as claimed in claim 6, wherein the feed back duct assembly further includes a refrigerating chamber supply opening in communication with a cold air discharge passage in the discharge guide.

8. The refrigerator as claimed in claim 1, wherein the barrier is stuffed with polyurethane, to form an insulating layer.

9. A refrigerator, comprising:

a heat exchange chamber with a front and a rear;

a cold air supplying device in communication with the front of the heat exchange chamber;

a discharge guide with a cold air discharge passage in communication with the cold air supplying device and a defrosted water drain passage;

a feed back duct assembly having a feed back duct and a defrosted water collector in communication with the defrosted water drain passage; and a feed back guide having an inlet side in communication with the feed back duct assembly, and an outlet side in communication with the rear of the heat exchange chamber.

10. The refrigerator as claimed in claim 9, wherein the defrosted water collector is formed at a center portion of a rear end of the feed back duct assembly, and the rear end of the feed back duct assembly is inclined toward the defrosted water collector.

11. The refrigerator as claimed in claim 10, wherein the feed back duct assembly includes a cavity for fitting electric components of the refrigerator.

12. The refrigerator as claimed in claim 9, wherein the feed back guide includes an opening sloped downward.

13. The refrigerator as claimed in claim 9, wherein the feed back guide includes a defrosted water draining opening connected to the defrosted water collector.

14. A refrigerator, comprising:

a cold air supplying device comprising, a cold air passage, which is formed by projecting a grill pan forward and fitting a cover onto a rear portion of the projection of the grill pan, and a cold air feed back opening formed in a portion other than the projection of the grill pan;

a discharge guide in communication with the cold air supplying device; and a cold air feed back device.

15. A refrigerator, comprising:

a cold air supplying device;

a discharge guide in communication with the cold air supplying device; and a cold air feed back device comprising, a feed back duct assembly having a feed back duct, and a feed back guide having an opening sloping downward, an inlet side in communication with an outlet side of the feed back duct assembly, and an outlet side in communication with a heat exchange chamber.

* * * * *